US006354983B1

(12) United States Patent
Lee

(10) Patent No.: US 6,354,983 B1
(45) Date of Patent: Mar. 12, 2002

(54) EXERCISE WHEEL

(76) Inventor: Chin-Tsun Lee, No. 32, Lane 6, Kuokuang 7$^{th}$ St., Yung Kang City, Tainan Hsien (TW)

( * ) Notice: Subject to any disclaimer, the term of this patent is extended or adjusted under 35 U.S.C. 154(b) by 0 days.

(21) Appl. No.: 09/780,362

(22) Filed: Feb. 12, 2001

(51) Int. Cl.$^{7}$ ..... A63B 21/22

(52) U.S. Cl. ..... 482/132; 482/140; 482/127; 482/907

(58) Field of Search ..... 482/132, 127, 482/907, 62, 116, 121, 126, 140, 147

(56) References Cited

U.S. PATENT DOCUMENTS 6,017,297 A * 1/2000 Collins ..... 482/146
6,146,318 A * 11/2000 Kuo ..... 482/132
6,196,955 B1 * 3/2001 Chuang ..... 482/132
6,254,518 B1 * 7/2001 Yu ..... 482/132
6,264,587 B1 * 7/2001 Lee ..... 482/132

* cited by examiner

*Primary Examiner*—Jerome W. Donnelly
(74) *Attorney, Agent, or Firm*—Charles E. Baxley

(57) ABSTRACT

An exercise wheel comprises a housing, two grip rods secured to two sides of the housing, respectively, a chassis housed by the housing, a main shaft supported by the chassis, a main gear mounted around the main shaft, and two wheel assemblies rotatably mounted to the chassis and each including a shaft with a toothed portion for meshing with the main gear. Two torsion springs are mounted around the main shaft and respectively located on both sides of the main gear. Each torsion spring includes a first end securely attached to the chassis and a second end securely attached to the main gear. The main gear further comprises a peripheral stop surrounding at least one of the torsion springs to thereby avoid radial outward expansion of the torsion springs.

3 Claims, 8 Drawing Sheets

EXERCISE WHEEL

BACKGROUND OF THE INVENTION

1. Field of the Invention

The present invention relates to an exercise wheel that may fix the travel thereof and prevent damage resulting from reverse rotation of torsion springs.

2. Description of the Related Art

FIGS. 5 through 7 of the drawings illustrate a conventional exercise wheel that includes a housing 20', a main gear 43', two wheel pairs 30', and two grip rods 50'. The housing 20' includes a compartment with a downwardly facing opening and aligned holes 26' on two sides thereof into which the grip rods 50' are mounted. Two stop rods 21' are mounted inside the housing 20'. One of the sides of the housing 20' has a hole 22' and two positioning holes 23', and two notches 24' are defined in a lower edge of the side of the housing 20'.

A main stem 251' of an adjusting member 25' is extended through the hole 22', a positioning peg 252' of the adjusting member 25' is extended through one of the positioning holes 23', and a stop stem 253' of the adjusting member 25' is extended through the notch 24'. A spring 254' is mounted around the main stem 251 ' for biasing the adjusting member 25'.

A main shaft 40' is extended through aligned holes 26' in the housing 20' and the main gear 43'. Two torsion springs 42'and 44' are mounted on both sides of the main gear 43' and around the main shaft 40' and an end cap 41', 45' is mounted to each outer end of the main axle 40'. Each wheel pair 30' is mounted in the housing 20' by an axle 27' and includes two rollers (not labeled) connected by a shaft (not labeled) that has teeth 31' formed on an outer periphery thereof for meshing with teeth (not labeled) of the main gear 43'. Each torsion spring 42', 44' includes a first end 421' securely attached to an associated stop rod 21' and a second end 422' securely attached to the main gear 43'.

When in use, the user bends downward and grasps the grip rods 50' attached to two ends of the main shaft 40' to make the wheel pairs 30' roll on the ground. During rolling of the wheel pairs 30', the torsion springs 42' and 44' are tensioned by the main gear 43' via transmission by the teeth of the main gear 43' and the teeth 31'. The second end 422' of each torsion spring 42', 44' bears against and is thus stopped by the stop stem 253' of the adjusting member 25' to thereby limit the forward travel of the exercise wheel.

Nevertheless, when the user operates the main gear 43' in the reverse direction, the torsion springs 42' might be damaged, as the torsion springs are twisted in the wrong direction, as shown in FIG. 8.

SUMMARY OF THE INVENTION

It is an object of the present invention to provide an exercise wheel that may limit the forward travel of the exercise wheel.

It is another object of the present invention to provide an exercise wheel that may prevent damage to the torsion springs when the exercise wheel is operated in the wrong direction.

In accordance with a first aspect of the invention, an exercise wheel comprises:

a housing having two sides;

two grip rods secured to the two sides of the housing, respectively;

a chassis housed by the housing and including two first stops each having a first side and a second side;

a main shaft supported by the chassis;

a main gear mounted around the main shaft and including a second stop;

two wheel assemblies rotatably mounted to the chassis and each including a shaft with a toothed portion for meshing with the main gear; and two torsion springs mounted around the main shaft and respectively located on both sides of the main gear, each said torsion spring including a first end securely attached to the chassis and a second end securely attached to the main gear;

wherein the second stop of the main gear bears against the first side of each said first stop of the chassis when the exercise wheel is in an initial state, thereby preventing rotational movement of the exercise wheel in a reverse direction; and wherein rotational movement of the exercise wheel in a forward direction is allowed until the second stop of the main gear is stopped by the second sides of the first stops of the chassis.

The main gear further comprises a peripheral stop surrounding at least one of the torsion springs to thereby avoid radial outward expansion of the torsion springs. The first side of each second stop of the chassis comprises a buffering portion.

In accordance with a second aspect of the invention, an exercise wheel comprises:

a housing having two sides;

two grip rods secured to the two sides of the housing, respectively;

a chassis housed by the housing;

a main shaft supported by the chassis;

a main gear mounted around the main shaft;

two wheel assemblies rotatably mounted to the chassis and each including a shaft with a toothed portion for meshing with the main gear; and two torsion springs mounted around the main shaft and respectively located on both sides of the main gear, each said torsion spring including a first end securely attached to the chassis and a second end securely attached to the main gear;

the main gear further comprising a peripheral stop surrounding at least one of the torsion springs to thereby avoid radial outward expansion of the torsion springs.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
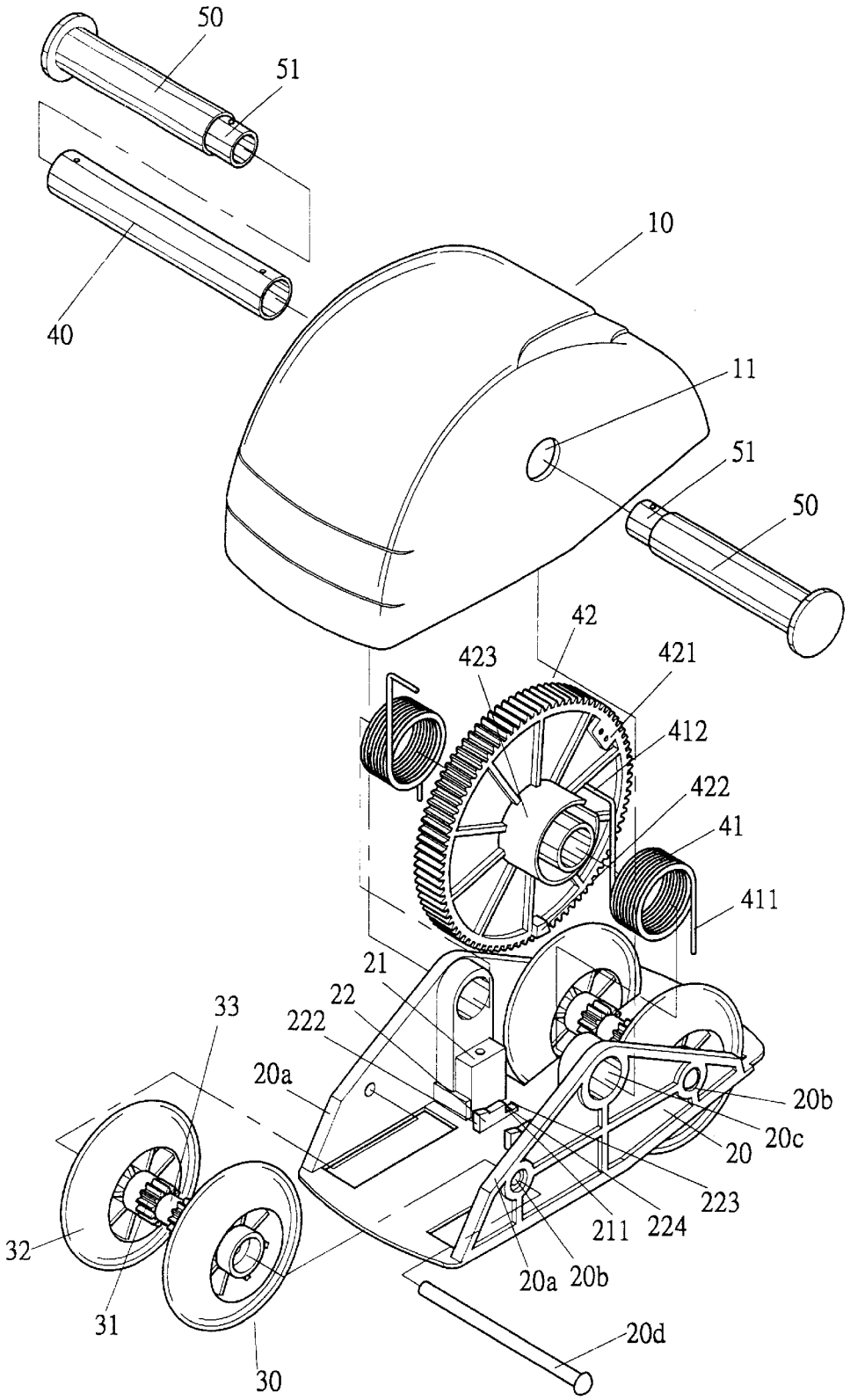
FIG. 1 is Exploded perspective view of an exercise wheel in accordance with the present invention.
Figure 2:
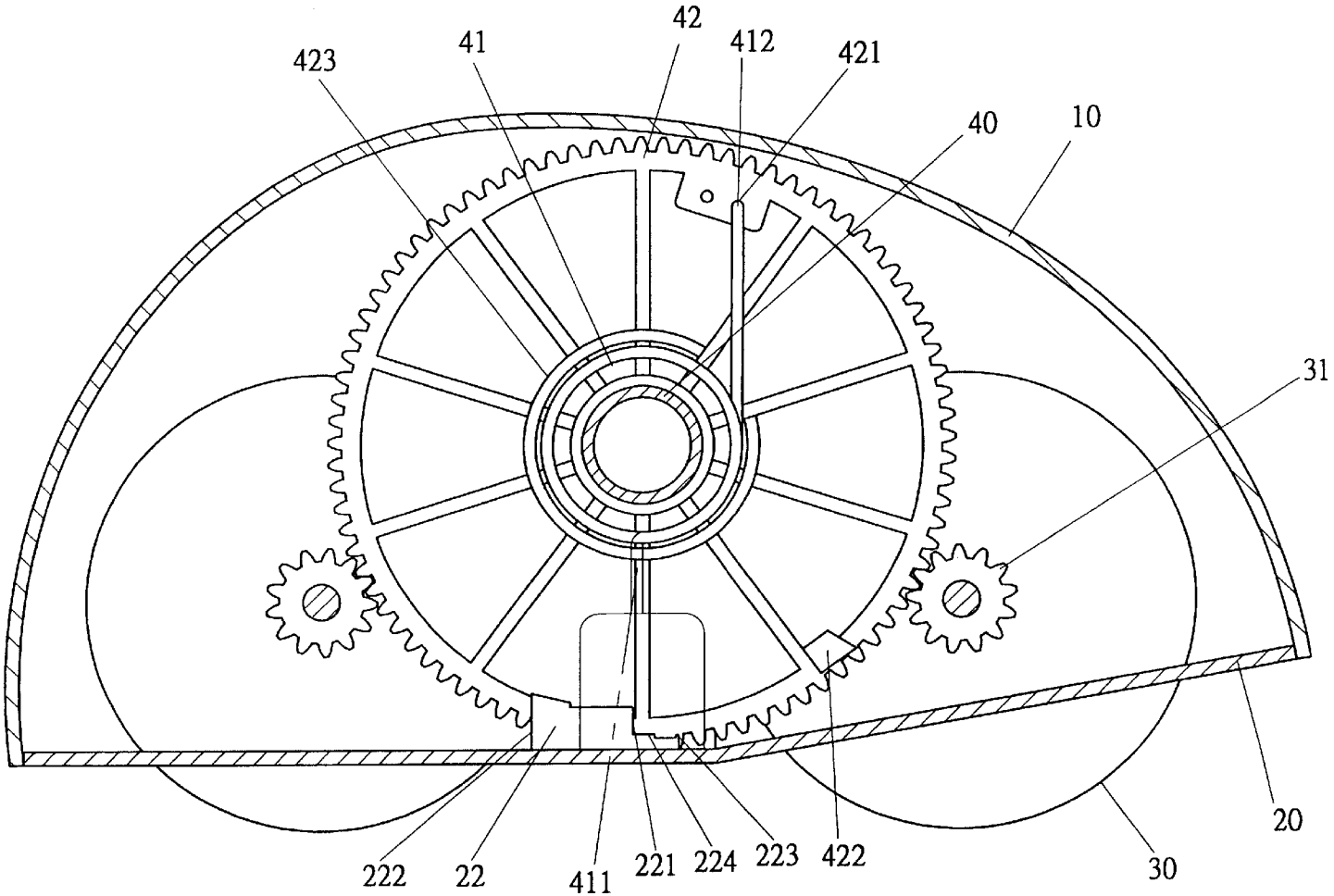
FIG. 2 a sectional view of the exercise wheel in FIG. 1.

Referring to FIGS. 1 through 4 and initially to FIGS. 1 and 2, an exercise wheel in accordance with the present invention generally includes a housing 10, a chassis 20, two wheel assemblies 30, a main shaft 40, and two grip rods 50. The housing 10 includes aligned holes 11 in two sides thereof for mounting the grip rods 50. More specifically, each grip rod 50 includes an end 51 that is secured in an associated hole 11 of the housing 10.

The chassis 20 includes two side walls 20*a* having aligned holes 20*b* for receiving axles 20*d* and aligned holes 20*c* for mounting the ends 51 of grip rods 50, respectively. The chassis 20 further includes two spaced engaging portions 21 each for engaging with a first end 411 of an associated torsion spring 41 that is mounted around the main shaft 40. The chassis 20 further includes a stop 22 on a bottom thereof for engaging with a stop 422 on a main gear 42 mounted around the main shaft 40 to rotate therewith. The stop 22 includes a first side 221 and a second side 222, which will be described later. The stop 22 further includes buffering portions 223 and 224 on the first side 221 thereof.

Each wheel assembly 30 includes a pair of wheels 32 connected by a hollow shaft 33, which, in turn, is mounted around an associated axle 20*d*, thereby allowing rotational movement of the wheels 32. The main gear 42 meshes with a toothed portion 31 of the hollow shaft 33 of each wheel assembly 30. Each torsion spring 41 includes a first end 411 attached to the associated engaging portion 21 of the chassis 20 and a second end 412 attached to an engaging portion 421 on a side of the main gear 42. The man gear 42 further includes a peripheral stop 423 on a side thereof surrounding at least one of the torsion springs 42 to thereby avoid radial outward expansion of the torsion springs 42.

Figure 3:
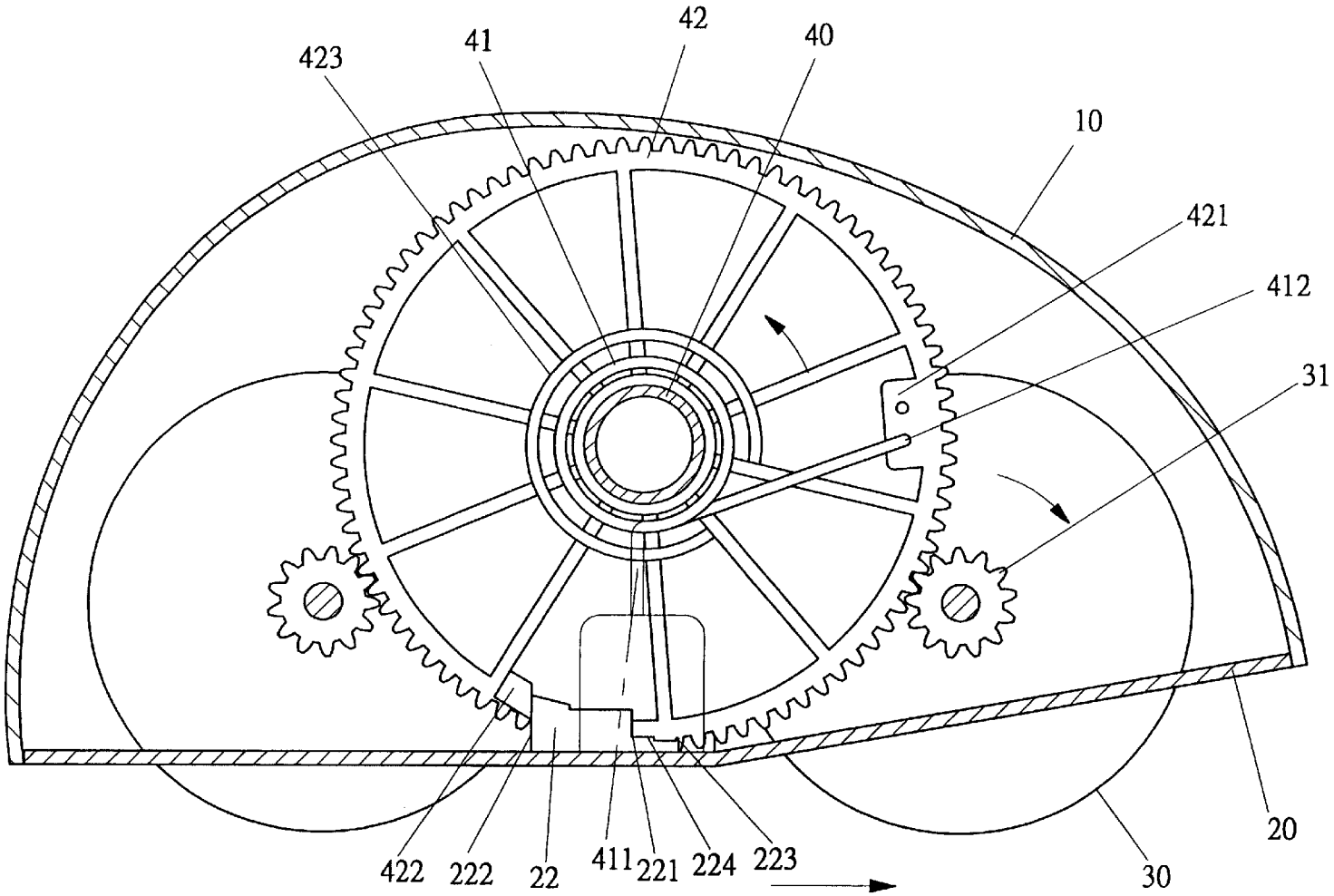
FIG. 3 a sectional view similar to FIG. 2, illustrating forward travel of the exercise wheel.

In assembly, as illustrated in FIG. 2, the stop 422 of the main gear 42 bears against the first side 221 of each stop 22 of the chassis 20. When the exercise wheel is moved in a forward direction, as shown in FIG. 3, each torsion spring 41 is twisted in the above-mentioned direction during rotation of the associated pair of wheels 32 with the stop 422 of the main gear 42 pressing against the second side 222 of each stop 22, thereby limiting forward travel of the exercise wheel and preventing excessive torsion of the torsion springs 42 which will lead to damage to the torsion springs 42. Further, when the exercise wheel is returned to its initial position, the wheel assemblies 30 are returned under the action of the torsion springs 41.

Figure 4:
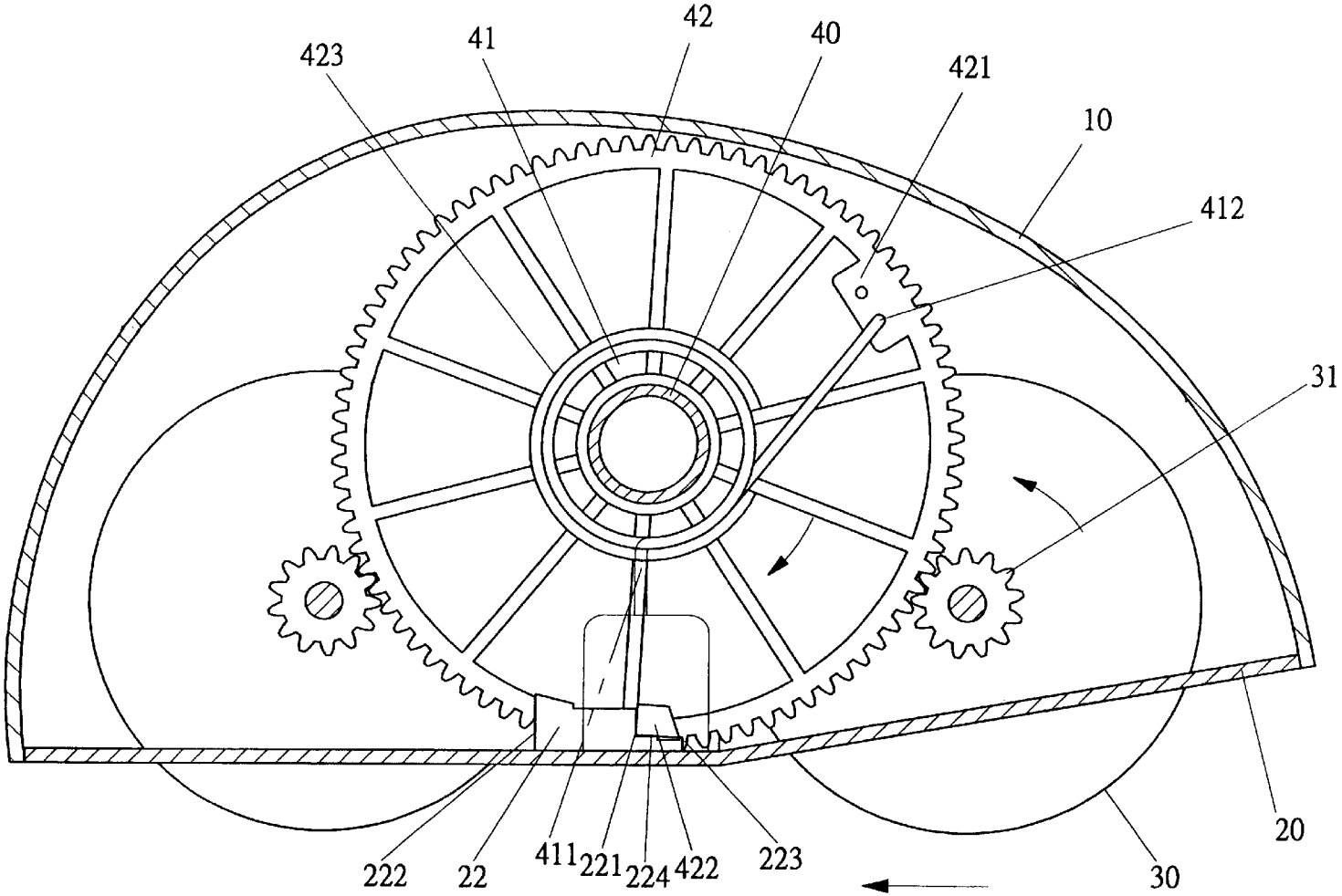
FIG. 4 is a schematic view similar to FIG. 2, illustrating reverse travel of the exercise wheel.
Figure 5:
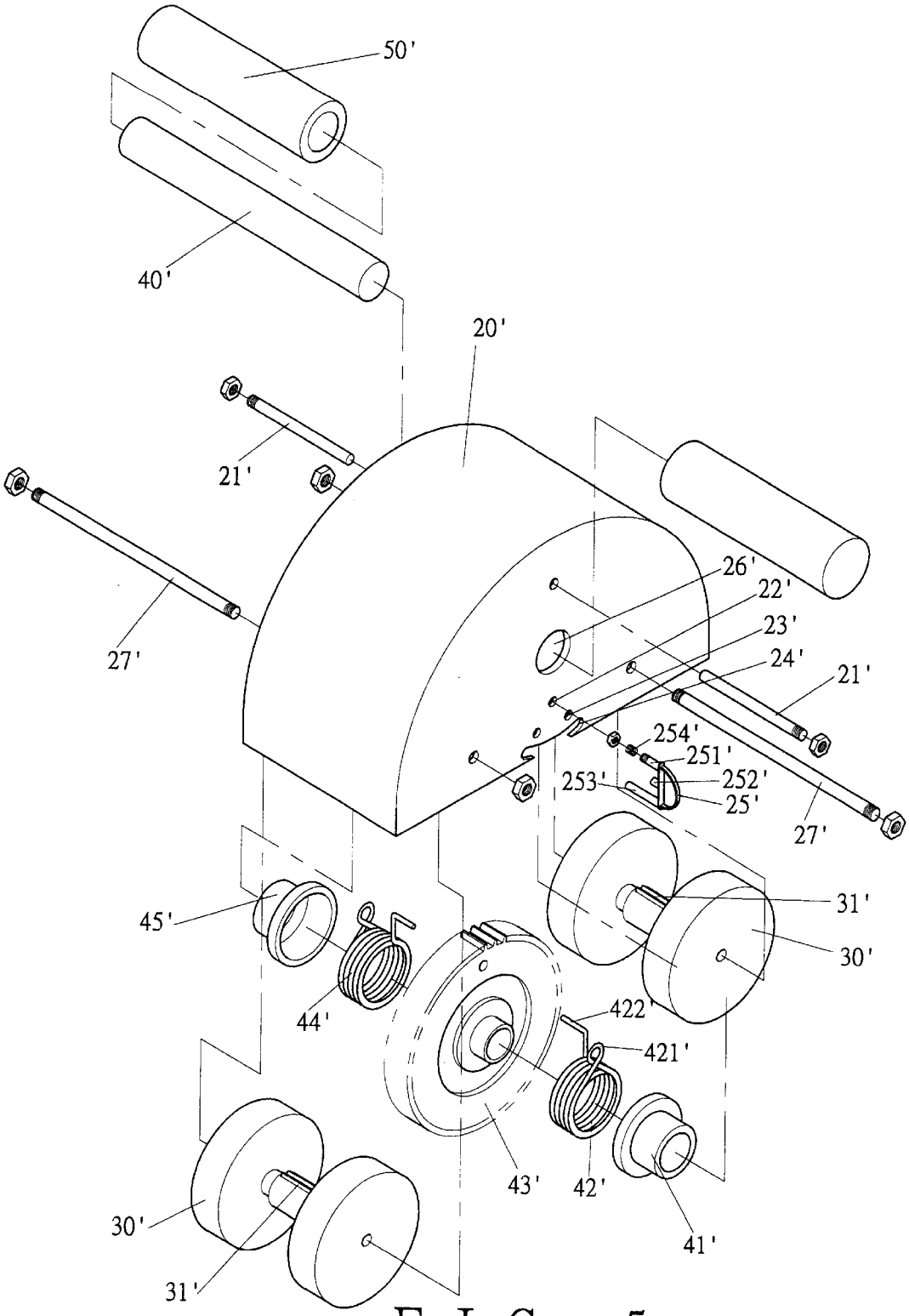
FIG. 5 is an exploded perspective view of a conventional exercise wheel.
Figure 6:
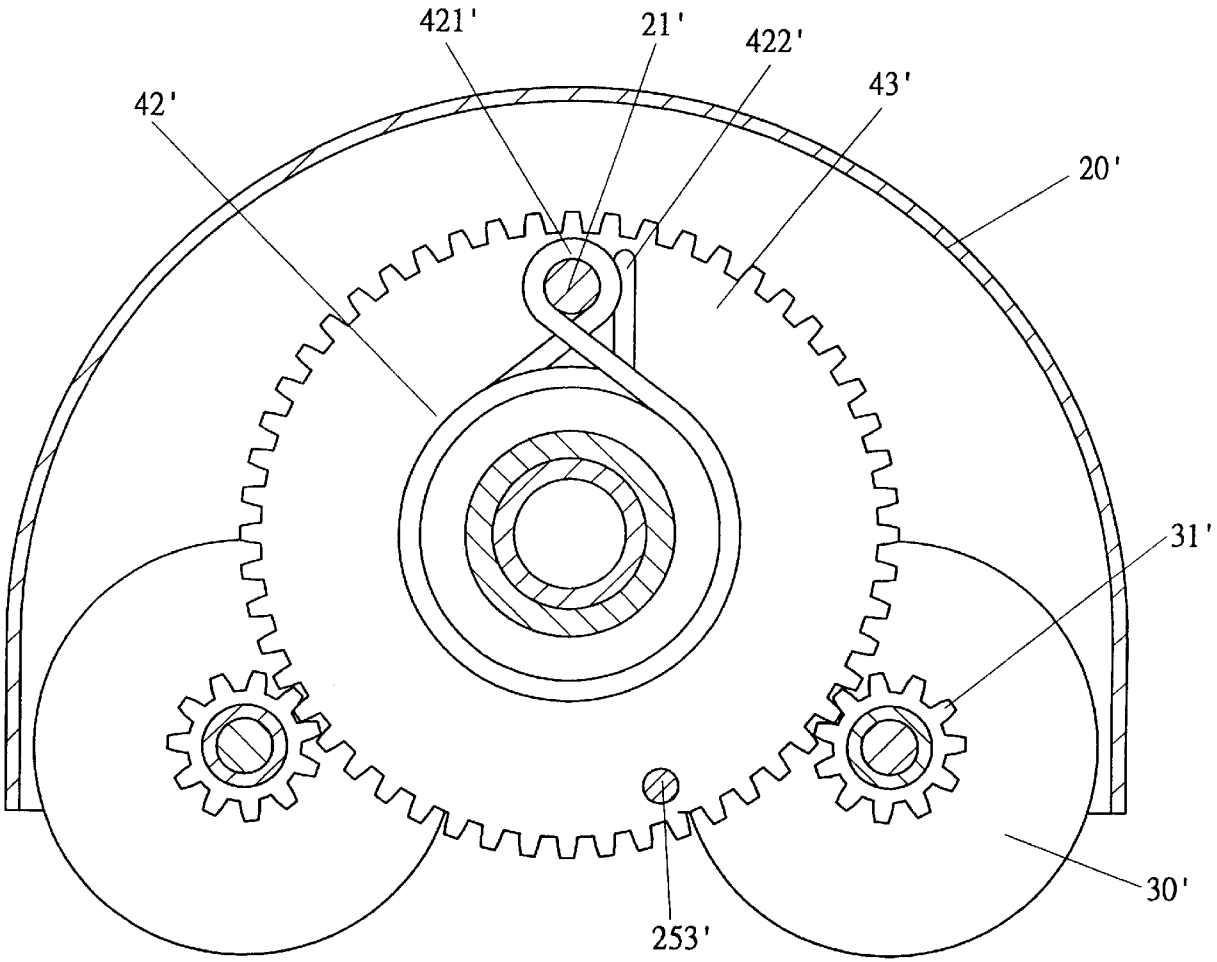
FIG. 6 is a sectional view of the conventional exercise wheel.
Figure 7:
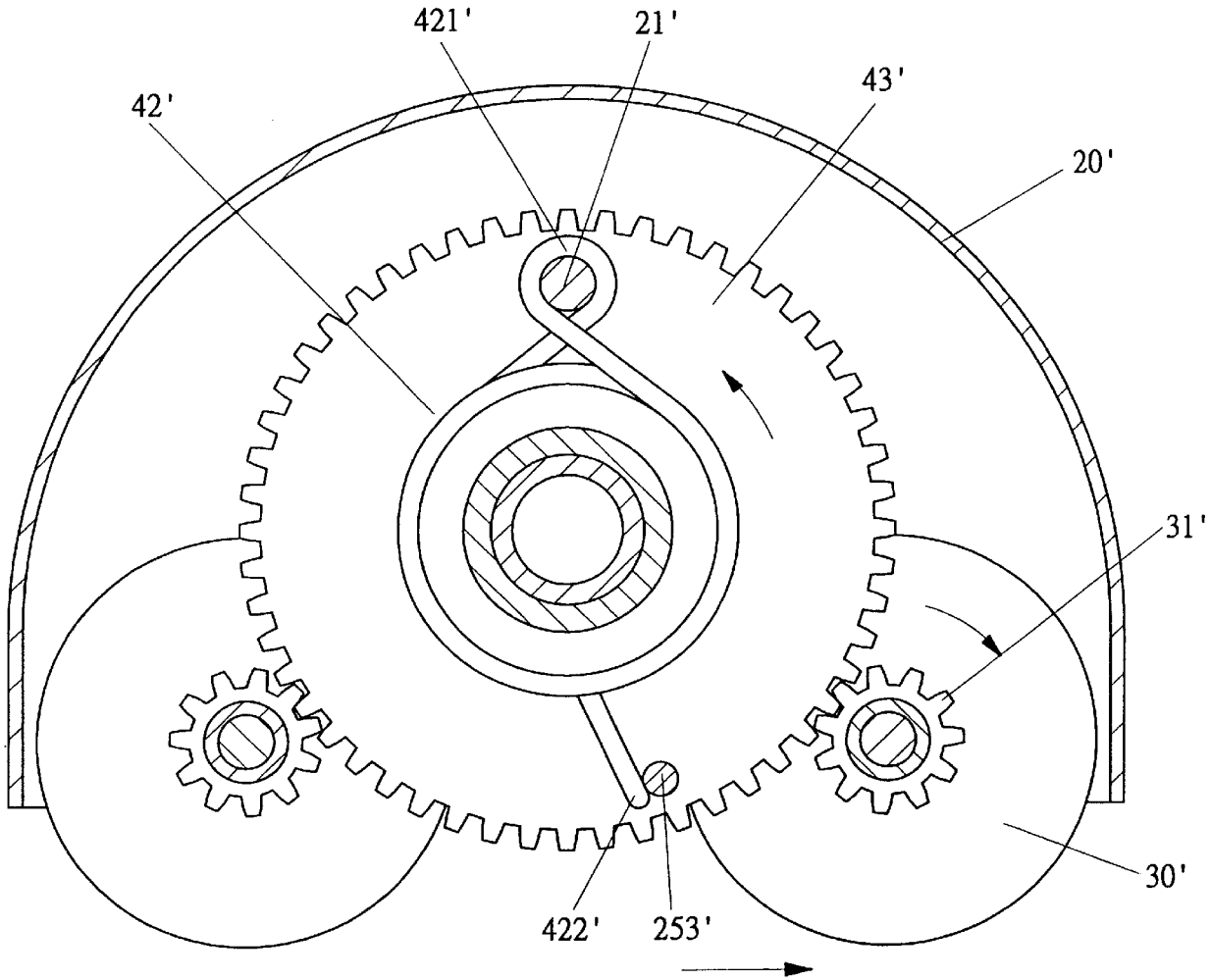
FIG. 7 is a sectional view illustrating forward travel of the conventional exercise wheel.
Figure 8:
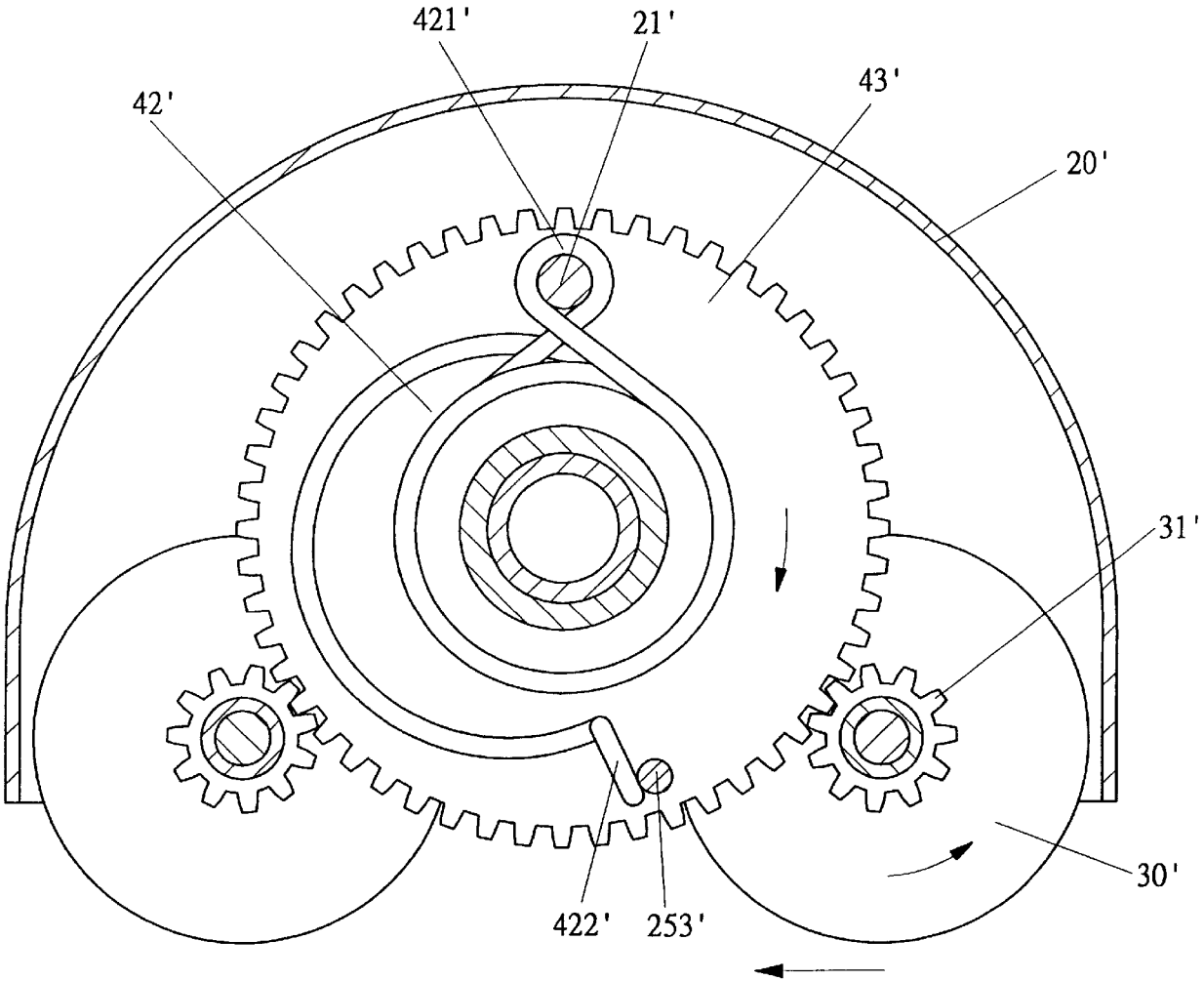
FIG. 8 is a sectional view illustrating reverse travel of the conventional exercise wheel.

Referring to FIG. 4, when the user operates the exercise wheel in the wrong direction (namely, in a direction opposite to the above-mentioned direction), a bottom of the stop 422 of the main gear 42 press against and thus are thus buffered by the buffering portions 223 and 224 and then engages with and are thus stopped by the first side 221 of each stop 22. As a result, the main gear 42 is not allowed to rotate in a reverse direction to thereby preventing radially outward expansion of the torsion springs 41 resulting from reverse rotation of the main gear 42. In addition, the buffering portions 223 and 224 prevent direct impact to the stops 22 by the stop 422 of the main gear 42, thereby preventing damage to the stops 22 and 422. Furthermore, the peripheral stop 423 on the main gear 42 may prevent radially outward expansion of the torsion springs 41 to thereby reliably prevent damage to the torsion springs 41. Thus, longevities of the torsion spring 41 and the exercise wheel are lengthened.

It is noted that either one of the stops 422 and 423 may prevent damage to the torsion springs, yet the effect would be better if both of them are provided on the main gear 42.

Although the invention has been explained in relation to its preferred embodiment, it is to be understood that many other possible modifications and variations can be made without departing from the spirit and scope of the invention as hereinafter claimed.

What is claimed is:

1. An exercise wheel comprising:

a housing having two sides;

two grip rods secured to the two sides of the housing, respectively;

a chassis housed by the housing and including two first stops each having a first side and a second side;

a main shaft supported by the chassis;

a main gear mounted around the main shaft and including a second stop;

two wheel assemblies rotatably mounted to the chassis and each including a shaft with a toothed portion for meshing with the main gear; and two torsion springs mounted around the main shaft and respectively located on both sides of the main gear, each said torsion spring including a first end securely attached to the chassis and a second end securely attached to the main gear;

wherein the second stop of the main gear bears against the first side of each said first stop of the chassis when the exercise wheel is in an initial state, thereby preventing rotational movement of the exercise wheel in a reverse direction; and wherein rotational movement of the exercise wheel in a forward direction is allowed until the second stop of the main gear is stopped by the second sides of the first stops of the chassis.

2. The exercise wheel as claimed in claim 1, wherein the main gear further comprises a peripheral stop surrounding at least one of the torsion springs to thereby avoid radial outward expansion of the torsion springs.

3. The exercise wheel as claimed in claim 1, wherein the first side of each said second stop of the chassis comprises a buffering portion.

* * * * *